US007350542B2

(12) United States Patent
Peeters et al.

(10) Patent No.: US 7,350,542 B2
(45) Date of Patent: Apr. 1, 2008

(54) BLOWING NOZZLE FOR SUPPORTING A WEFT THREAD IN A WEAVING MACHINE

(75) Inventors: Jozef Peeters, Ypres (BE); Hendrik Hiemstra, Deurne (NL)

(73) Assignee: Picanol N.V. naamloze vennootschap (BE)

( * ) Notice: Subject to any disclaimer, the term of this patent is extended or adjusted under 35 U.S.C. 154(b) by 138 days.

(21) Appl. No.: 10/539,584

(22) PCT Filed: Dec. 16, 2003

(86) PCT No.: PCT/BE03/00221

§ 371 (c)(1),
(2), (4) Date: Jun. 17, 2005

(87) PCT Pub. No.: WO2004/057080

PCT Pub. Date: Jul. 8, 2004

(65) Prior Publication Data

US 2006/0011253 A1 Jan. 19, 2006

(30) Foreign Application Priority Data

Dec. 19, 2002 (BE) ..... 20020740

(51) Int. Cl.
*D03D 47/30* (2006.01)
*D03D 49/50* (2006.01)

(52) U.S. Cl. ..... 139/116.1; 139/435.1; 139/435.2; 139/435.5; 139/435.6

(58) Field of Classification Search ..... 139/116.1, 139/435.1, 435.2, 435.5, 435.6
See application file for complete search history.

(56) References Cited

U.S. PATENT DOCUMENTS

| | | | | | |
|---|---|---|---|---|---|
| 3,978,896 | A * | 9/1976 | Larmit | 139/435.5 |
| 4,290,460 | A * | 9/1981 | Deborde | 139/435.2 |
| 4,304,269 | A * | 12/1981 | Suzuki et al. | 139/435.5 |
| 4,314,590 | A * | 2/1982 | Suzuki et al. | 139/435.5 |
| 4,354,533 | A * | 10/1982 | Suzuki et al. | 139/435.1 |
| 4,372,348 | A * | 2/1983 | Gunneman | 139/435.5 |
| 4,442,871 | A * | 4/1984 | Suzuki et al. | 139/435.5 |
| 4,585,038 | A * | 4/1986 | Knisely | 139/435.5 |
| 4,794,958 | A * | 1/1989 | Maes et al. | 139/435.5 |
| 4,915,141 | A * | 4/1990 | Nitta et al. | 139/435.5 |
| 5,649,571 | A * | 7/1997 | Miyahara et al. | 139/435.5 |
| 6,138,719 | A * | 10/2000 | Kerner et al. | 139/435.5 |
| 6,536,482 | B1 * | 3/2003 | Peeters et al. | 139/435.5 |

FOREIGN PATENT DOCUMENTS

| | | |
|---|---|---|
| BE | 1012608 | 1/2001 |
| DE | 3739767 | 1/1989 |
| JP | 60173143 | 9/1985 |
| NL | 1001277 | 3/1997 |

* cited by examiner

*Primary Examiner*—Robert Muromoto
(74) *Attorney, Agent, or Firm*—Bacon & Thomas PLLC

(57) ABSTRACT

Blowing nozzle for supporting a weft thread in a weaving machine, provided with a flow-through canalisation (17) for a fluid tracing a bend (20) near the free end of the blowing nozzle (3) to subsequently flow into the environment via at least one outlet opening (18), wherein a jet pipe (21) is formed in this flow-through canalisation (17), and the jet pipe (21) is integrated in the bend (20).

16 Claims, 5 Drawing Sheets

BLOWING NOZZLE FOR SUPPORTING A WEFT THREAD IN A WEAVING MACHINE

The present invention concerns a blowing nozzle for supporting a weft thread in a weaving machine, in other words a blowing nozzle for creating a fluid jet for transporting a weft thread along the reed of the weaving machine through the weaving shed.

In the first place is meant by such a blowing nozzle a relay nozzle for an airjet weaving machine, but it is clear that more generally also other blowing nozzles should be understood by it, also for other fluids than air.

It is known that such blowing nozzles can be made in different shapes, as far as the inner shape is concerned as well as the outer shape. The inner shape determines the flow of the fluid leaving the blowing nozzle, in other words of the outgoing fluid jet. Naturally, the aim hereby is for such fluid jet to be as strong as possible and to extend in one particular direction, in order to be able to act as efficiently as possible on a weft thread.

From Belgian patent No. 1,012,608 is known a blowing nozzle for supporting a weft thread of a weaving machine which is provided with a flow-through canalisation for a fluid tracing a bend near the free end of the blowing nozzle to subsequently flow into the environment via an outlet opening, whereby a jet pipe is integrated in this flow-through canalisation in order to improve the efficiency of the outgoing jet. The jet pipe is hereby situated in the part of the flow-through canalisation extending as of the above-mentioned bend up to the outlet opening, which is disadvantageous in that there is little room available for optimizing the jet nozzle. Moreover, the fluid has to be guided through a first narrowing in the bend first, before reaching the critical section of the jet pipe. Due to these successive narrowings, it is not excluded that unwanted turbulences are created.

The present invention aims an improved blowing nozzle with which can be obtained, in general, a more efficient fluid jet and, more in particular, which remedies the above-mentioned disadvantages.

To this end, the invention concerns a blowing nozzle for supporting a weft thread in a weaving machine which is provided with a flow-through canalisation for a fluid tracing a bend near the free end of the blowing nozzle to subsequently flow into the environment via at least one outlet opening, whereby a jet pipe is formed in this flow-through canalisation, characterised in that the above-mentioned jet pipe is integrated in the above-mentioned bend. By integrating the jet pipe in the bend is obtained a more even flow-through. The fluid is hereby simultaneously forced through the bend in a smooth movement and subjected to the jet pipe effect.

Preferably, the flow-through canalisation is made such that it narrows, from before the above-mentioned bend up to the narrowest section of the jet nozzle, in particular the critical section. Thus is obtained that no other narrowings are found before the narrowest section of the jet nozzle which have a negative influence on the jet pipe effect.

The flow-through canalisation is preferably made such that it widens as of the critical section of the above-mentioned jet pipe up to the outlet opening. By this is meant that the opposite walls in this part of the flow-through canalisation move away in relation to each other and/or are parallel to each other at specific locations at the most. Thus, turbulences are avoided in this part, and the jet pipe effect will be optimally transmitted up into the fluid jet leaving the outlet opening.

According to a preferred embodiment, the blowing nozzle is characterised in that the part of the flow-through canalisation extending as of the critical section of the jet pipe up to the outlet opening has one or several of the following characteristics:

- that the upper wall of this part is concave and/or straight as of the critical section up to the outlet opening, in other words that no convex part is provided, which offers the advantage that the fluid can expand after the critical section, and that it is moreover avoided, thanks to the absence of a convex part, that the fluid will trace a bend in the wrong direction, thus excluding unwanted shock waves or compression waves;
- that at least the part of the upper wall which is directly connected to the critical section is made concave, which offers the advantage that the fluid is immediately forced in the desired direction;
- that the upper wall of the above-mentioned part is exclusively concave as of the critical section up to the outlet opening, which offers the advantage that a regular expansion is obtained as of the critical section to the outlet opening;
- that the upper wall of the above-mentioned part has a concave curve with a weak bend providing for a gradual change of direction of the upper wall over 20 degrees at the most, which offers the advantage that, thanks to this upper wall, there can be no turbulences;
- that the lower wall of the above-mentioned part has at least a straight part near the outlet opening so that, near the far end, there can be no more unwanted expansions or compressions;
- that at least the part of the lower wall of the above-mentioned part which is connected directly to the critical section is made convex, which offers the advantage that this results in expansion waves and thus in a supersonic flow, and that a wall bend is immediately obtained extending in the right bend direction, so that the fluid is further bent in an even manner as of the critical section;
- that the lower wall of the above-mentioned part as of the critical section up to the outlet opening exclusively consists of a convex part, followed by a straight part, whereby the advantages of the aforesaid two paragraphs are combined.

According to a particularly preferred characteristic, the narrowing part preceding the critical section of the jet pipe has an upper wall which extends at least with a concave part into the critical section, as opposed to a conventional construction of a jet pipe. Thus, the fluid is optimally bent through the bend to subsequently end up directly in the critical section.

The flow-through canalisation preferably has a rectangular or an almost rectangular section at the jet pipe, jet pipes respectively, as a result of which a uniform jet pipe effect is obtained in the width. This is particularly useful when the lower wall and upper wall are asymmetrical.

Although the above-mentioned characteristics can be combined according to different possibilities, the blowing nozzle according to the invention preferably shows at least the following combination of characteristics in order to maximally optimize the outflow characteristics: that the flow-through canalisation narrows from the part preceding the narrowest section up to this narrowest section of the jet pipe, in particular the critical section; that the flow-through canalisation widens as of the critical section of the above-mentioned jet pipe up to the outlet opening; and that the part of the flow-through canalisation which extends as of the critical section of the jet pipe up to the outlet opening has an upper wall which is made exclusively concave and a lower wall which first has a convex curve as of the critical section and then follows a straight or almost straight curve.

It should be noted that the specific combination of a number of the above-mentioned characteristics of the flow-through canalisation also results in better flow-through characteristics, even when the jet pipe is not situated in the aforesaid bend. According to a second aspect, the invention also concerns a blowing nozzle for supporting a weft thread in a weaving machine which is provided with a flow-through canalisation for a fluid flowing into the environment via at least one outlet opening, whereby a jet pipe is formed in this flow-through canalisation, which thus is not necessarily situated in the above-mentioned bend, characterised in that the flow-through canalisation narrows from the part preceding the narrowest section up to this narrowest section of the jet pipe, in particular the critical section; that the flow-through canalisation widens as of the critical section up to the outlet opening; and that the part of the flow-through canalisation which extends as of the critical section up to the outlet opening has an upper wall which is made exclusively concave, and has a lower wall which first has a convex curve as of the critical section and then a straight or almost straight curve.

Also the above-mentioned fact that the jet pipe is made with a rectangular section is inventive as such. According to a third aspect, the invention also concerns a blowing nozzle for supporting a weft thread in a weaving machine which is provided with a flow-through canalisation for a fluid flowing into the environment via at least one outlet opening, whereby this flow-through canalisation has at least one duct in which is integrated a jet pipe, characterised in that every duct concerned has a rectangular section at least at the height of the accompanying jet pipe.

In order to better explain the characteristics of the invention, the following preferred embodiments are described as an example only without being limitative in any way, with reference to the accompanying drawings, in which:

FIG. 1 schematically represents a part of a weaving machine with several blowing nozzles according to the invention;

Figure 4:
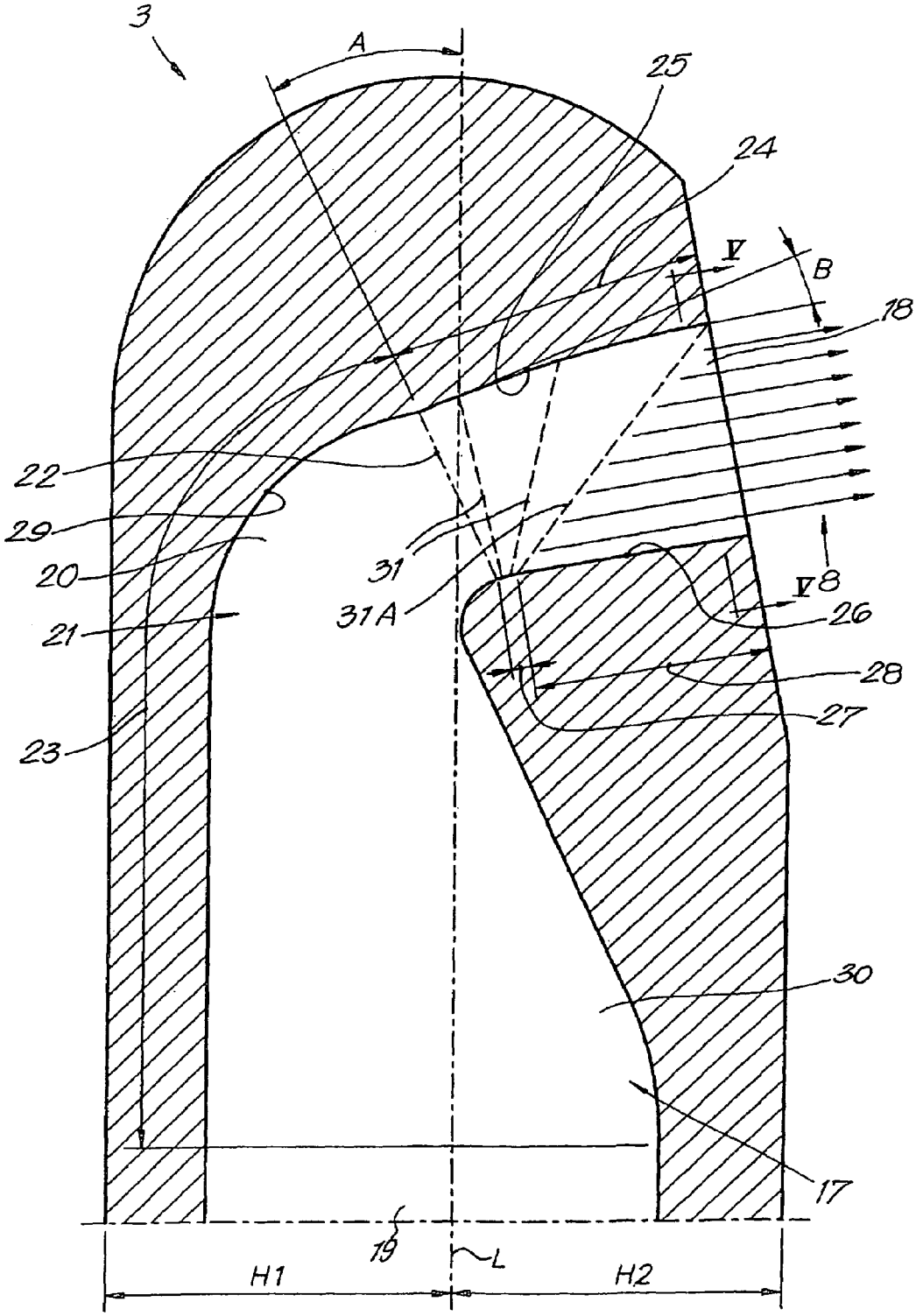
FIG. 4 represents the part indicated by F4 in FIG. 3 to a larger scale.
Figure 8:
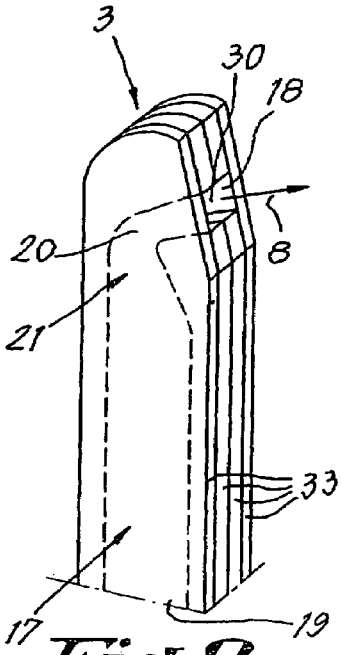
FIG. 8 represents another embodiment of a blowing nozzle according to the invention.
Figure 9:
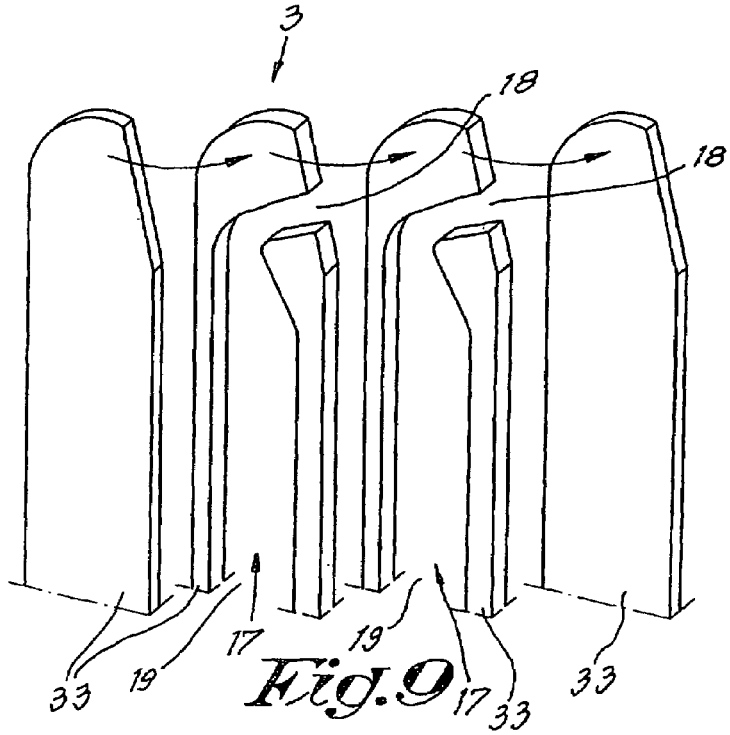
Figure 13:
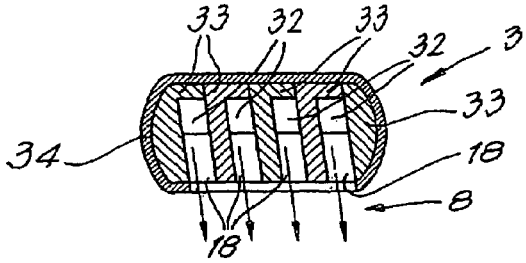
Figure 14:
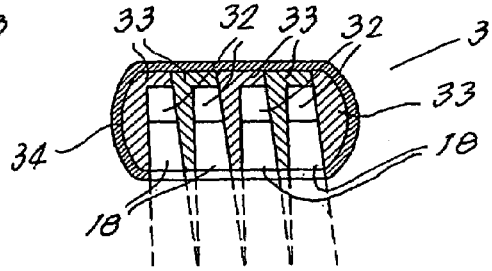
Figure 10:
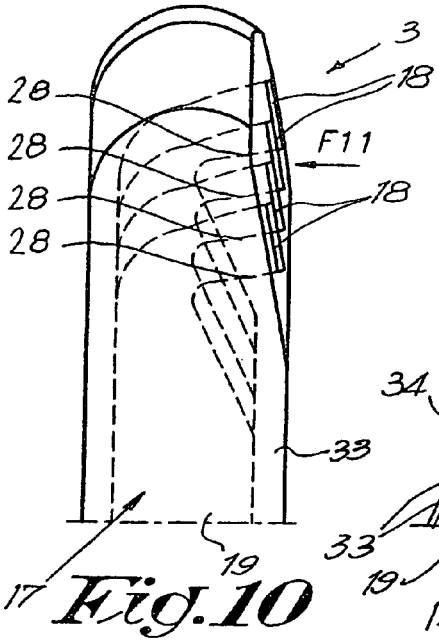
Figure 11:
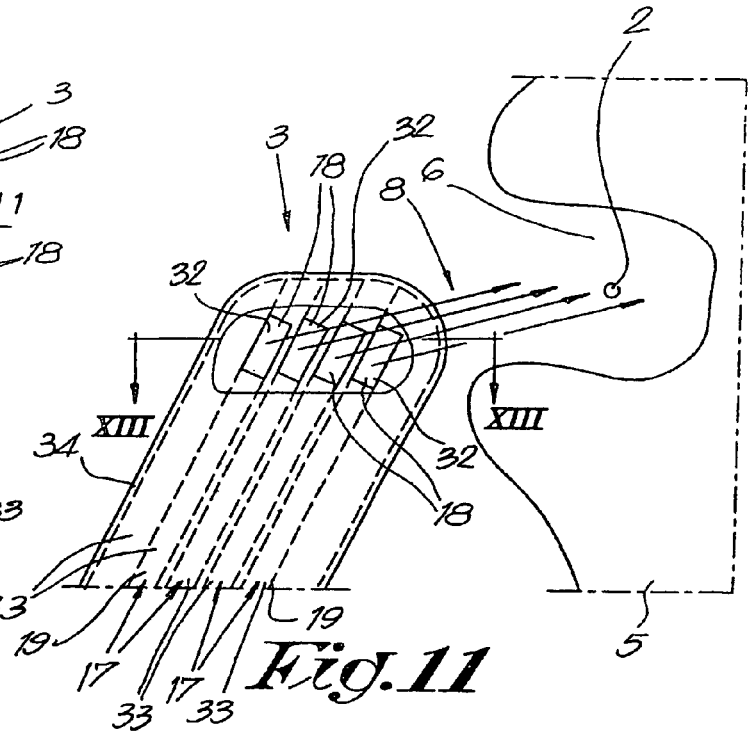
Figure 12:
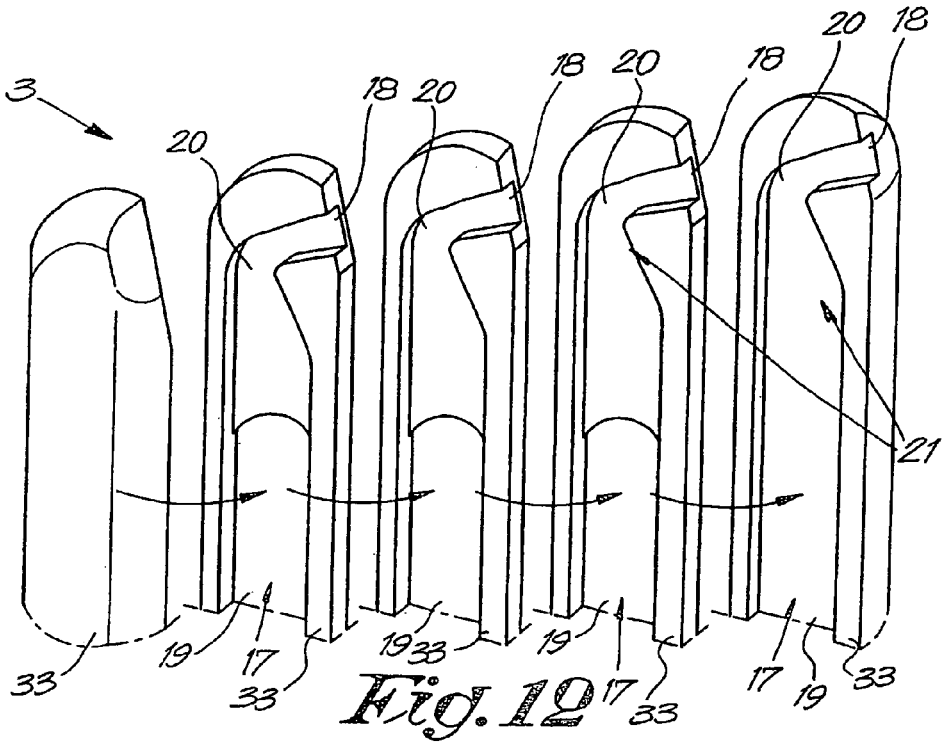
Figure 15:
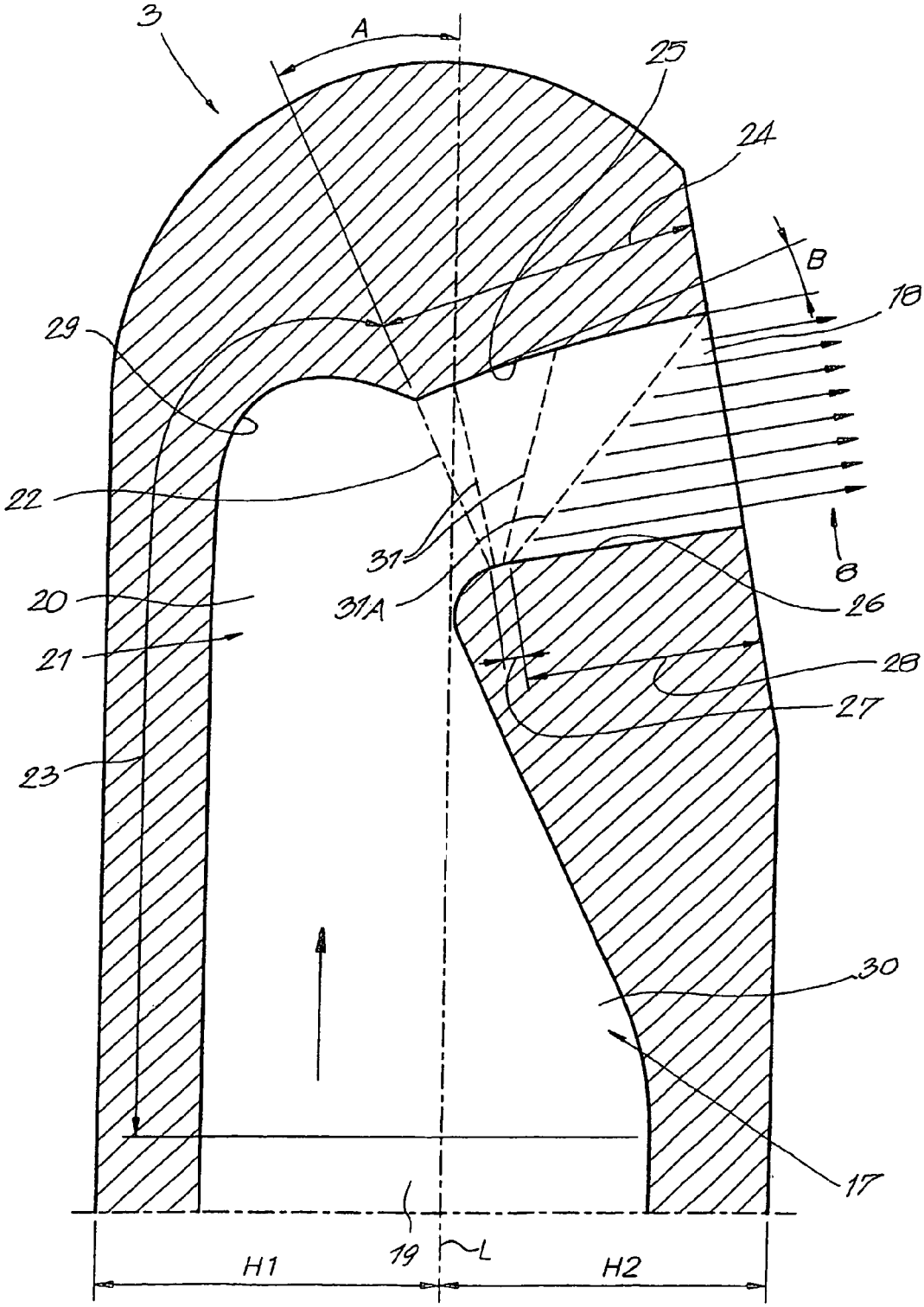

FIG. 9 schematically represents how the embodiment from FIG. 8 has been built;

FIG. 10 represents another practical embodiment of the invention;

FIG. 11 represents a view according to arrow F11 in FIG. 10;

FIG. 12 schematically represents how the embodiment from FIGS. 10 and 11 has been built;

FIG. 13 represents a section according to line XIII-XIII in FIG. 11;

FIG. 14 represents a variant of FIG. 13;

FIG. 15 represents a variant of FIG. 4.

Figure 1:
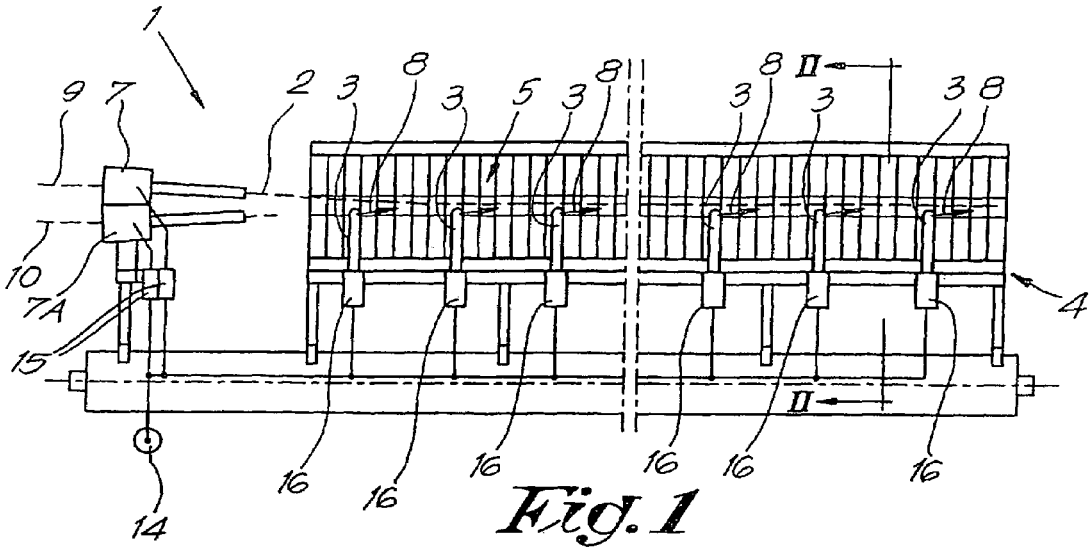
Figure 2:
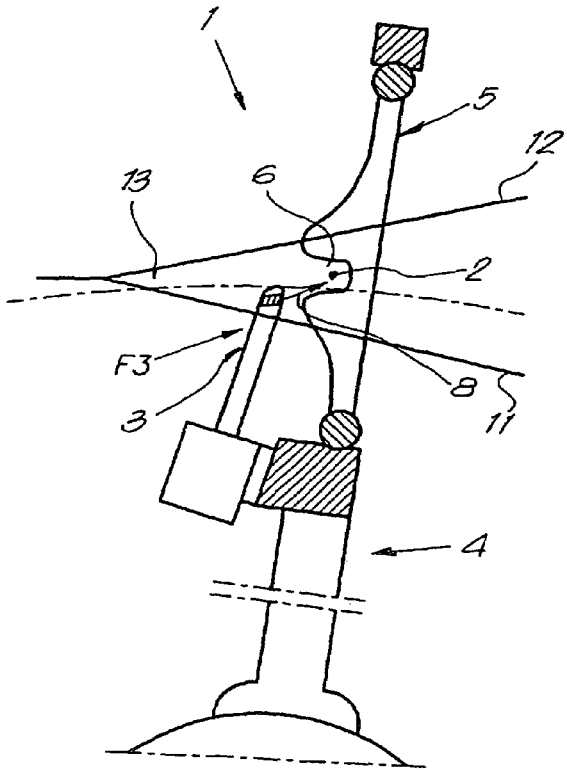
FIG. 2 represents a section according to line II-II in FIG. 1 to a larger scale.

FIGS. 1 and 2 schematically represent a device 1 for inserting weft threads 2 in a weaving machine, provided with blowing nozzles 3, embodied according to the invention.

The device 1 comprises a sley 4 with a reed 5 which is provided with a guide duct 6 through which the weft thread 2 is transported. The weft thread 2 is blown in the guide duct 6 by means of a main nozzle 7 and it is further supported by fluid jets 8, in this case air jets, which are generated via the blowing nozzles 3. As is known, several main nozzles 7-7A can be provided to insert weft threads 2 in the weaving shed as of different weft yarns 9-10.

As represented in FIG. 2, the blowing nozzles 3 extend through the lower warp threads 11 with their top ends during the insertion of the weft thread 2 into the shed 13 formed by the lower and upper warp threads 11-12. Both the main nozzles 7-7A and the blowing nozzles 3 are fed with a fluid under pressure by means of a fluid source 14, for example compressed air, and they are controlled in the known manner by means of valves 15-16 or the like.

Figure 3:
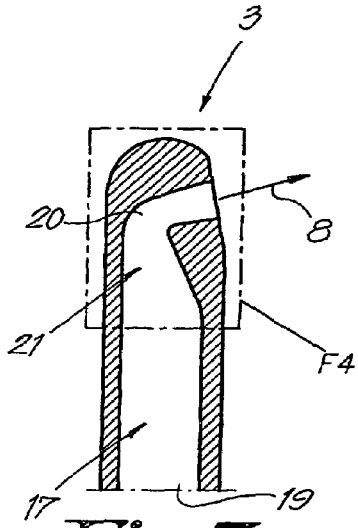
FIG. 3 represents the blowing nozzle which is indicated by F3 in FIG. 2 as a section.
Figure 5:
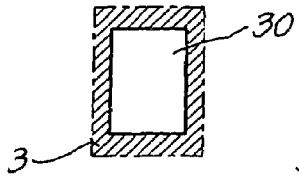
FIG. 5 represents a section according to line V-V in FIG. 4.

As represented in FIGS. 3 to 5, the blowing nozzles 3 are provided with a flow-through canalisation 17 for the fluid, in this case a single duct which opens in the environment by means of an outlet opening 18. This flow-through canalisation 17 mainly consists of a supply part 19 which mainly extends in the longitudinal direction of the blowing nozzle 3 and a bend 20 connected to it, after which said flow-through canalisation 17 opens directly or indirectly in the environment via the above-mentioned outlet opening 18.

The present invention is special in that a jet pipe 21 is formed in the flow-through canalisation 17 which is integrated in the bend 20.

The flow-through canalisation 17 is made as a permanently narrowing part 23 from before the above-mentioned bend 20, more in particular as of the end of the supply part 19 up to the narrowest section of the jet pipe 21, in particular the critical section 22.

The critical section 22 is situated at least partially halfway H1 the blowing nozzle 3 situated opposite to the half H2 in which the outlet opening 18 has been provided, in relation to the longitudinal axis L of the blowing nozzle 3. The critical section 22 hereby forms an angle A with the longitudinal axis L which amounts to at least 15 degrees, and which is preferably situated between 15 and 40 degrees.

The part 24 of the flow-through canalisation 18 which extends as of the critical section 22 up to the outlet opening 18 is made such that it only widens.

The part 24, as represented, moreover shows the following combination of characteristics:

- an upper wall 25 which has an exclusively concave curve as of the critical section 22 up to the outlet opening 18 and which has a weak bend providing for a gradual change of direction of the upper wall 25 over 20 degrees at the most, in other words that the angle B indicated in FIG. 4 is smaller than or equal to 20 degrees;
- a lower wall 26 of which the part 27 which is directly connected to the critical section 22 is made convex, whereby this convex part 27 is immediately followed by a rectilinear or almost rectilinear part 28 extending up to the outlet opening 18. By almost rectilinear is meant as rectilinear as possible.

The narrowing part 23 which precedes the critical section 22 has an upper wall 29 which extends at least with a concave part into the critical section 22.

As represented in FIG. 5, the flow-through canalisation 17 preferably has a rectangular section, which can be either or not square at least at the jet pipe 21, anyhow when it consists of a single duct 30.

By realising the inner walls of the flow-through canalisation 17 as mentioned above, the respective advantages mentioned in the introduction are obtained. More specifically, this design makes it possible for supersonic flow speeds to be developed on the one hand, whereas the creation of shock waves is nevertheless excluded or at least minimised on the other hand.

By supplying fluid under pressure, it is guided, while it is already being forced to trace a bend, into the critical section 22 itself. After the critical section 22 follows an expansion with expansion lines 31, as represented in FIG. 4, whereby 31A represents the last expansion line.

It should be noted hereby that no convex part is provided on the upper wall 25, right after the critical section 22. Such a part could allow the fluid to expand, but it would also make the fluid trace a bend in the wrong direction. This disadvantage is avoided, according to a preferred characteristic of the invention, by starting with a concave upper wall 25 right after the critical section 22. Moreover, this concave part can be calculated such that no compression waves or shock waves are generated, which is realised by making sure that the expansion lines 31 evenly fan out as of the critical section 22 into the location of the last expansion line 31A represented in FIG. 4.

Thanks to the slight convex part 27, the fluid is bent in the right direction and, thanks to the rectilinear part 28, any further expansions or compressions are prevented after the expansion line 31A, and it is also made sure that the fluid jet 8 leaves the blowing nozzle 3 according to the direction of the part 28, such that a parallel flowing out is obtained.

Figure 6:
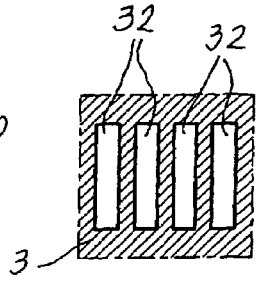
FIGS. 6 and 7 represent sections analogous to those of FIG. 5, but for two variants.
Figure 7:
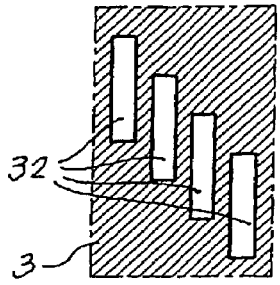

It is clear that several variants are possible. Thus, for example, several outlet openings 18 can be applied in a single blowing nozzle 3, which are each provided with their own jet pipe 21. FIGS. 6 and 7 represent two examples thereof, whereby the outlet openings 18 are situated next to each other, in FIG. 6 at the same height, and in FIG. 7 shifted steplike in height.

Also, as represented in FIGS. 6 and 7, the outlet opening 18, as well as the ducts 32 situated in front of it, preferably have a rectangular section which extends longitudinally in height.

Although it is not excluded to provide several outlet openings 18 on top of each other and to each feed them via a jet pipe, it is preferred to use outlet openings 18 which are exclusively provided next to each other such that, per outlet opening 18, the maximum height can be used to build in a jet pipe.

The use of a round section is not excluded. This is for example possible by realising the ducts 30-32 with circular sections, whereby the circles coincide at the top with an upper wall 25, as defined above, and coincide with a lower wall 26 at the bottom, as defined above.

According to a preferred embodiment, the blowing nozzles 3 according to the invention are composed of segments 33 which, as represented in FIGS. 8 and 9, are placed against each other. These segments 33 are preferably made in the shape of a plate, as represented. In particular, use can be made to this end of plates applied against each other and whereby material parts have been taken out of certain plates in order to form the aforesaid ducts 30-32.

Such a construction with segments 33 offers the advantage that the inner shape of the ducts 30-32 can be formed very precisely, as the inner sides are easily accessible, as opposed to the case whereby the duct 30 or the ducts 32 have to be provided in a massive body.

FIGS. 10 to 13 represent an embodiment of a blowing nozzle 3 with gradually arranged outlet openings 18, whereby this blowing nozzle 3 is also composed of segments 33 around which is provided an envelope 34 in this case. The ducts 32 are hereby arranged such that the outgoing fluid jets, in particular the air jets 8, make a vertical as well as a horizontal angle with the longitudinal direction of the reed 5. The vertical angle is hereby determined by the direction of the rectilinear parts 28 described by means of FIG. 4. The directions of each of these parts 28 are hereby preferably parallel to each other. The horizontal angle is obtained as the plate-shaped segments 33, as represented in FIG. 13, are placed at an angle.

Nor is it excluded, as represented in FIG. 14, to give the dividing walls variable thicknesses, for example such that the flow-through canalisation according to the flow direction widens in the cross direction, such that a three-dimensional rectangular jet pipe is realised.

As represented in FIG. 15, the flow-through canalisation 17 of the blowing nozzle 3 is made such that it narrows from the part preceding the narrowest or critical section 22 up to this critical section 22 of the blowing nozzle. Due to this, the airflow is not negatively influenced just before ending up to the critical section 22. The narrowing part preceding the critical section 22 has an upper wall 29 which ends with a concave part into the critical section 22. In order to increase the jet pipe effect and to obtain a smooth flow of the fluid through the jet pipe, it may be advantageous to provide an upper wall 29 that has a recess part in the outer side of the bend 20 of the nozzle. This shape of the upper wall 29 allows that enough fluid can be supplied near the upper end of the critical section 22 in order to provide a smooth flow of the fluid after the critical section 22 along the jet pipe. This is especially the case when fluid is supplied at a high pressure, thus causing supersonic flow speeds of the fluid along the jet pipe.

It should be noted that by 'top wall' is always meant the wall situated on the outer side of the bend 20, whereas by 'lower wall' is meant the side situated on the inside of the bend 20. It is clear, however, that such a blowing nozzle 3 can be applied in different positions in practice, whereby the 'upper wall' must not necessarily be situated above the 'lower wall'.

The present invention is by no means limited to the above-described embodiments given as an example and represented in the accompanying drawings; on the contrary, such a blowing nozzle can be made in different, shapes and dimensions while still remaining within the scope of the invention.

The invention claimed is:

1. Blowing nozzle for supporting a weft thread in a weaving machine, said nozzle including a flow-through canalisation for a fluid tracing a bend near the free end of the blowing nozzle to subsequently flow into the environment via at least one outlet opening, wherein a jet pipe is formed in this flow-through canalisation, said jet pipe being integrated in said bend and having a narrower section defining a critical section of the jet pipe, wherein said flow-through canalisation narrows from a part preceding said critical section to said critical section, and wherein said flow-through canalisation has a part that extends from the critical section to said outlet opening and that has an upper wall which is exclusively concave, the upper wall extending from said critical section to said outlet opening.

2. Blowing nozzle according to claim 1, wherein said critical section is located at least partially half-way within the blowing nozzle that is located opposite the half in which the outlet opening is provided, relative to the longitudinal axis of the blowing nozzle.

3. Blowing nozzle according to claim 1, wherein said critical section forms an angle with the longitudinal axis of the blowing nozzle which amounts to at least 15 degrees.

4. Blowing nozzle according to claim 1, wherein the flow-through canalisation is made such that it widens from the critical section of said jet pipe up to the outlet opening.

5. Blowing nozzle according to claim 1, wherein the part of the flow-through canalisation which extends from the critical section of the jet pipe up to the outlet opening has one or several of the following characteristics:

- the upper wall of said part is concave and/or straight from the critical section up to the outlet opening;
- at least the part of the upper wall of said part which is connected to the critical section is made concave;
- the upper wall of said part is exclusively concave from the critical section up to the outlet opening;
- the upper wall of said part is concave with a bend providing for gradual change of direction of the upper wall over 20 degrees at the most;
- the lower wall of said part has a rectilinear or almost rectilinear part at least near the outlet opening;
- at least the part of the lower wall which is connected directly to the critical section is made convex;
- the lower wall of said part from the critical section up to the outlet opening exclusively comprises a convex part, followed by a rectilinear or almost rectilinear part.

6. Blowing nozzle according to claim 1, wherein the narrowing part preceding the critical section of the jet pipe has an upper wall extending at least with a concave part into the critical section.

7. Blowing nozzle according to claim 1, wherein the flow-through canalisation widens from the critical section up to the outlet opening; and the part of the flow-through canalisation which extends from the critical section up to the outlet opening has a lower wall which first has a convex curve from the critical section and then follows a rectilinear or almost rectilinear curve.

8. Blowing nozzle according to claim 1, wherein the flow-through canalisation comprises one or several ducts which have a rectangular section at least at the jet pipe and the following part.

9. Blowing nozzle according to claim 1, wherein the flow-through canalisation has several ducts which each have their own jet pipe and which open into the environment via their own outlet opening.

10. Blowing nozzle according to claim 9, wherein the outlet openings of said ducts are located exclusively next to each other, whereby they are either or not mutually shifted in height.

11. Blowing nozzle according to claim 10, wherein the outlet openings are arranged step-like.

12. Blowing nozzle according to claim 1, wherein the blowing nozzle is at least partially composed of segments in between which or in which are provided one or several ducts in order to form the flow-through canalisation.

13. Blowing nozzle according to claim 1, wherein the flow-through canalisation comprises of one or several ducts which open into one or several outlet openings, wherein said duct or these ducts are arranged such that the outgoing fluid jet or jets form a vertical as well as a horizontal angle with the longitudinal direction of a reed of the weaving machine.

14. Blowing nozzle for supporting a weft thread in a weaving machine, said nozzle including a flow-through canalisation for a fluid flowing into the environment via at least one outlet opening; a jet pipe formed in the flow-through canalisation, wherein the flow-through canalisation narrows from a part preceding the narrowest section up to the narrowest section of the jet pipe, namely a critical section; wherein the flow-through canalisation widens from the critical section up to the outlet opening; and wherein a part of the flow-through canalisation which extends from the critical section up to the outlet opening has an upper wall which is made exclusively concave and which extends from the critical section to the outlet opening, and has a lower wall which first has a convex curve from the critical section and then a straight or almost straight section.

15. Blowing nozzle for supporting a weft thread in a weaving machine, said nozzle provided with a flow-through canalisation for a fluid flowing into the environment via at least one outlet opening wherein the flow-through canalisation has at least one duct in which is integrated a jet pipe, wherein the jet pipe is integrated in a bend of the flow-through canalisation, wherein said at least one duct has a rectangular section at least at the respective jet pipe, and wherein a part of said flow-through canalisation preceding a critical section of said jet pine narrows to the critical section, and a part of said flow-through canalisation extending from said critical section to said outlet opening has an upper wall which is exclusively concave and which extends from said critical section to said outlet opening.

16. Blowing nozzle according to claim 1, wherein the critical section forms an angle with the longitudinal axis of the blowing nozzle of between 15 and 40 degrees.

* * * * *